US009487279B1

(12) United States Patent
Frehm

(10) Patent No.: US 9,487,279 B1
(45) Date of Patent: Nov. 8, 2016

(54) SIGNALING APPARATUS FOR COUPLING TO AN EMERGENCY FLOTATION DEVICE

(71) Applicant: Richard Sadu Frehm, West Palm Beach, FL (US)

(72) Inventor: Richard Sadu Frehm, West Palm Beach, FL (US)

( * ) Notice: Subject to any disclaimer, the term of this patent is extended or adjusted under 35 U.S.C. 154(b) by 0 days.

(21) Appl. No.: 15/153,149

(22) Filed: May 12, 2016

(51) Int. Cl.

| | |
|---|---|
| ***F21L 4/00*** | (2006.01) |
| ***F21V 25/00*** | (2006.01) |
| ***F21V 31/00*** | (2006.01) |
| ***B63C 9/20*** | (2006.01) |
| ***B63C 9/11*** | (2006.01) |
| ***F21V 23/06*** | (2006.01) |
| ***F21V 23/04*** | (2006.01) |
| ***F21V 33/00*** | (2006.01) |

(52) U.S. Cl.
CPC . *B63C 9/20* (2013.01); *B63C 9/11* (2013.01); *F21V 23/0407* (2013.01); *F21V 23/0414* (2013.01); *F21V 23/06* (2013.01); *F21V 33/0064* (2013.01)

(58) Field of Classification Search
CPC ..... F21V 23/04; F21V 23/0407; F21V 23/0414; F21V 23/0421; F21V 23/06; F21V 33/0064; B63C 9/20
See application file for complete search history.

(56) References Cited

U.S. PATENT DOCUMENTS

| | | | | |
|---|---|---|---|---|
| 4,896,620 | A | 1/1990 | Jones | |
| 5,029,293 | A | 7/1991 | Fontanille | |
| 5,231,781 | A | 8/1993 | Dunbar | |
| 5,311,100 | A | 5/1994 | Brain | |
| 5,370,566 | A | 12/1994 | Mitchell, Jr. et al. | |
| 7,195,369 | B2 | 3/2007 | Shaw | |
| 7,753,576 | B2 | 7/2010 | Marcinkewicz et al. | |
| 7,859,425 | B2 | 12/2010 | Glasa et al. | |
| 8,337,040 | B1 * | 12/2012 | Easley | F21L 13/00 362/183 |
| 8,618,940 | B2 | 12/2013 | Ford | |
| 8,888,310 | B2 * | 11/2014 | Dayan | F21V 31/005 362/122 |
| 2006/0092630 | A1 | 5/2006 | Kennedy et al. | |
| 2007/0153507 | A1 | 7/2007 | Tarter et al. | |

(Continued)

FOREIGN PATENT DOCUMENTS

| | | |
|---|---|---|
| EP | 2 420 437 A1 | 2/2012 |
| WO | 2015189581 | 12/2015 |

*Primary Examiner* — Peggy Neils
*Assistant Examiner* — Alexander Garlen

(57) ABSTRACT

A signaling apparatus having a first and second conductive surface on an outward facing surface of a base section. First and second arms of a coupling element are configured to couple to the base, the coupling element comprising conductive material such that the first and second conductive surfaces are conductively coupled when the first arm contacts the first conductive surface and the second arm contacts the second conductive surface. The first and second conductive surfaces are configured to be conductively coupled for an amount of time when a body of water spans from the first to the second conductive surface. The electrical circuitry includes a switching means configured to move a timing circuit of the electrical circuitry to an activated state when the first and second surfaces are coupled to each other such that light is emitted from the light emitting device at a predetermined repeating lighting pattern.

20 Claims, 10 Drawing Sheets

(56) References Cited

U.S. PATENT DOCUMENTS

| | | | | |
|---|---|---|---|---|
| 2007/0153523 | A1* | 7/2007 | Thornhill et al. | F21L 4/00 362/276 |
| 2008/0205049 | A1 | 8/2008 | Brain | |
| 2008/0289241 | A1 | 11/2008 | Hawryshyn et al. | |
| 2008/0310149 | A1* | 12/2008 | Chan | F21S 6/001 362/186 |
| 2009/0109677 | A1* | 4/2009 | Coushaine et al. | F21L 4/00 362/267 |
| 2009/0251321 | A1 | 10/2009 | Delorey | |
| 2009/0251323 | A1 | 10/2009 | Snyder | |
| 2010/0219775 | A1 | 9/2010 | Maglica et al. | |
| 2011/0136399 | A1 | 6/2011 | Mandrik | |
| 2011/0211331 | A1 | 9/2011 | Alkjaer | |
| 2012/0164898 | A1 | 6/2012 | Mckinney | |

* cited by examiner

SIGNALING APPARATUS FOR COUPLING TO AN EMERGENCY FLOTATION DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field of emergency flotation devices, and more specifically to the field of signaling apparatus used with emergency flotation devices.

BACKGROUND

Humans have been traveling the seas and other bodies of water for thousands of years. During that time flotation devices, such as inflatable life vests, were used in order to assist and protect passengers from drowning while at sea. More recently, lamp units were used mounted directly to the life vests. The lamp units have been used to provide a light signal so that a wearer could more easily be seen by others. Certain life vests also included a survival lamp unit with water-response switches. For example, U.S. Pat. No. 5,311,100 to Brain discloses a water-activated survival lamp unit with a water-responsive activated switch.

However, U.S. Pat. No. 5,311,100 has several disadvantages. One of the main disadvantages of U.S. Pat. No. 5,311,100 is that the vest disclosed must be immersed in water in order to function properly. In many cases, the lamp unit of U.S. Pat. No. 5,311,100 may not be fully immersed in water when the light is required. As a result, in many cases the lamp unit of U.S. Pat. No. 5,311,100 may become inoperable. For example, if the vest is worn by a person in a lifeboat, but not fully immersed, the light signal of U.S. Pat. No. 5,311,100 will not be activated, rendering the invention useless.

Another problem with many of the lamp units of certain life vests is that the life vests have connections and wires that extend into and out of the main portion of the device. For example, U.S. Pat. No. 7,195,369 to Shaw discloses a safety light for use with aquatic garments. However, U.S. Pat. No. 7,195,369 teaches leads (disclosed as leads 42 in FIG. 3) that protrude out of the main lens (taught as lens 65 in FIG. 3) of the device. Having leads extend beyond the body of the lens creates additional exposure to the elements. This additional expose to the element may cause the lamp unit to malfunction if the leads become affected by the elements, such as salt water, salt air, water etc.

Another problem with many of the existing life vests is that that once a light emitting device used with the life vest, such as a Light Emitting Diode ("LED"), is activated, the light emitting device may draw a load that can relatively quickly drain a battery or power supply used to power the light emitting device. When lost at sea, it is critical to have a power source that can provide power to the LED or other light source for as long as possible. However, the existing technologies used with the existing life vests are not configured to sufficiently extend the battery life. Additionally, another problem with many flotation devices is that when a life vest is coupled directly to the life vest, light may only be emitted in one direction. For example, if a vest is attached directly to a life vest, and if that portion of the life vest—for some reason—is positioned downward, then light will not be emitted upward thereby rendering certain embodiments of the invention inoperable.

As a result, there exists a need for improvements over the prior art and more particularly for a better and more efficient signaling apparatus for use with emergency flotation devices.

SUMMARY

A signaling apparatus for coupling to an emergency flotation device is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a signaling apparatus for coupling to an emergency flotation device is disclosed. The signaling apparatus comprises (a) a hermetically sealed housing for encasing a light emitting device. The light emitting device is configured to be conductively coupled, via electrical circuitry, with a power source for powering said light emitting device. The housing comprises a transmissive section for allowing light to pass through said housing. A cylindrical base section is coupled below the transmissive section. A first conductive surface is positioned on an outward facing surface of the cylindrical base, and a second conductive surface is positioned on the outward facing surface of the cylindrical base. At least one groove is positioned on the outward facing surface of the cylindrical base. The at least one groove includes the first conductive surface arranged proximate to a first section of said groove and the second conductive surface arranged proximate to a second section of said groove. The signaling apparatus also includes a coupling element configured to rotatably couple within said groove of the cylindrical base. The coupling element comprises a lever element, a first curved arm having a first inwardly protruding element, a second curved arm having a second inwardly protruding element. The coupling element is configured such that the first and second arms partially clamp the cylindrical base and the inwardly protruding elements are positioned within said groove. The coupling element comprises conductive material such that the first conductive surface is conductively coupled with the second conductive surface when the first inwardly protruding element contacts the first conductive surface and the second inwardly protruding element contacts the second conductive surface. The first conductive surface and second conductive surface are configured to be conductively coupled for an amount of time when a body of water spans, for at least momentarily, from the first conductive surface to the second conductive surface. The electrical circuitry includes a switching means configured to move a timing circuit of the electrical circuitry from an inactivated state to an activated state when the first and second surfaces are conductively coupled to each other. In the deactivated state, the timing circuit is configured to prevent electrical current from the power source from flowing to the light emitting device. In the activated state the timing circuit is configured to allow electrical current from the power source to flow to the light emitting device such that light is emitted from the light emitting device at a predetermined repeating lighting pattern. The timing circuit is configured to remain in the activated state for an amount of time greater than the amount of time the first and second surfaces are conductively coupled to each other.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1B:
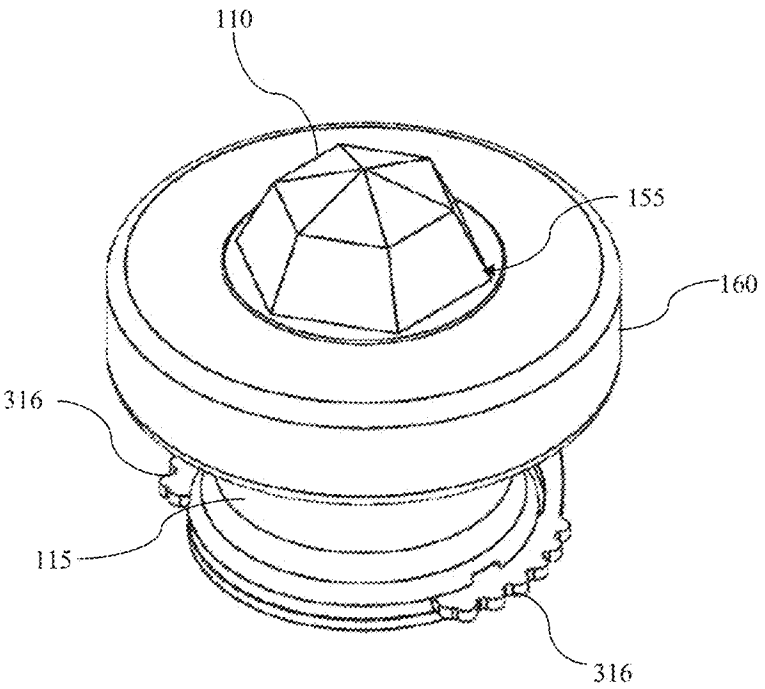
FIG. 1B is a perspective view of a signaling apparatus having a buoyant ring coupled thereto, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a signaling apparatus for use with a flotation device that has a hermetically sealed housing that encapsulates the signaling device. The disclosed embodiments also improve over the prior art by providing a device that is buoyant so that it can be attached to a life jacket or life raft thereby being able to emit light in all directions (360 degrees) upward. The disclosed embodiments also include a buoyant ring that cannot transmit light thereby decreasing the amount of light emitting downwards and thereby decreasing the risk of harm from sea life attached to the light. The disclosed embodiments improve over the prior art by providing contact surfaces or probes on the outward facing surface of the device such that the circuit is closed when water spans, for at least momentarily between the contacting surfaces coupling the contact surfaces. The disclosed embodiments improve over the prior art by also providing a mechanical switch to conductively couples the contacting surfaces when the apparatus is not immersed in water. The disclosed embodiments improve over the prior art by providing a timing circuit that extends the battery life of the device and thereby extending the length of time that the signaling device can emit light.

Figure 1A:
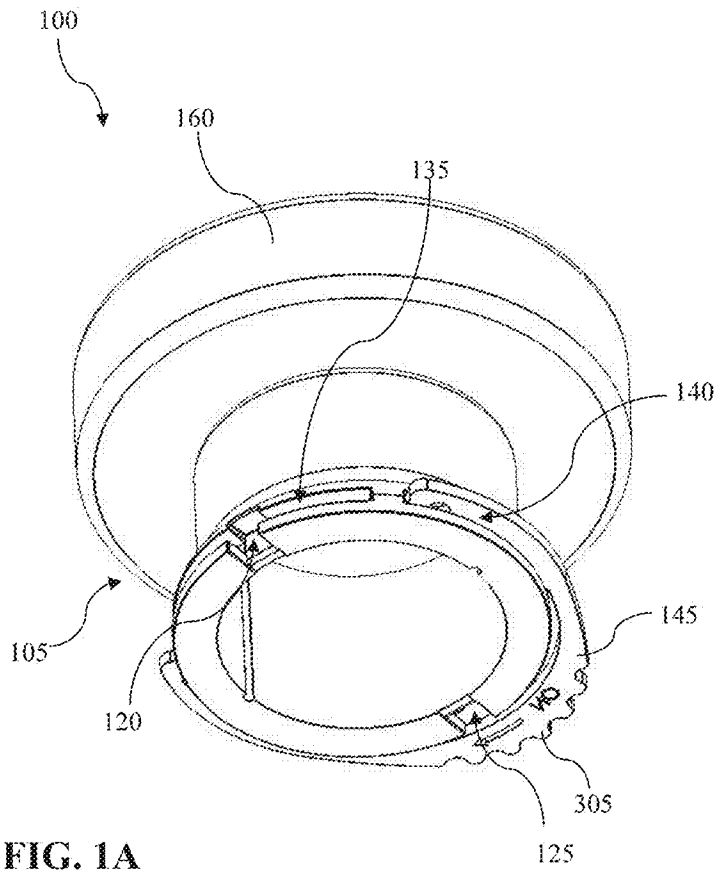
FIG. 1A is a perspective view of a signaling apparatus having a buoyant ring coupled thereto, according to an example embodiment.
Figure 7:
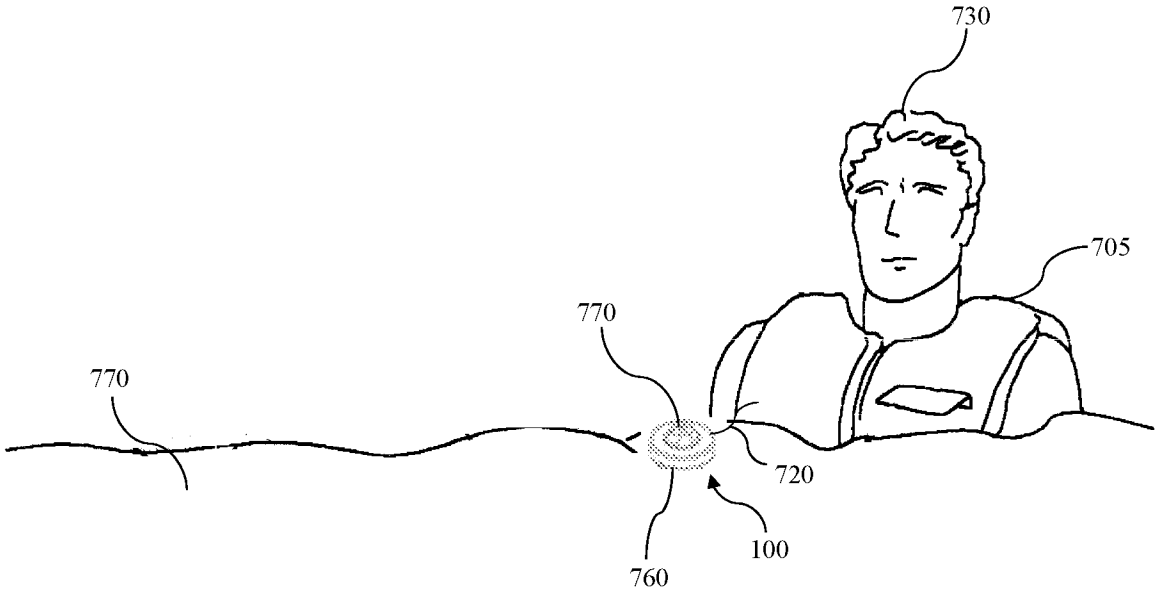
FIG. 7 is a perspective view of a signaling apparatus floating in water and coupled to a life vest by a lanyard.
Figure 8:
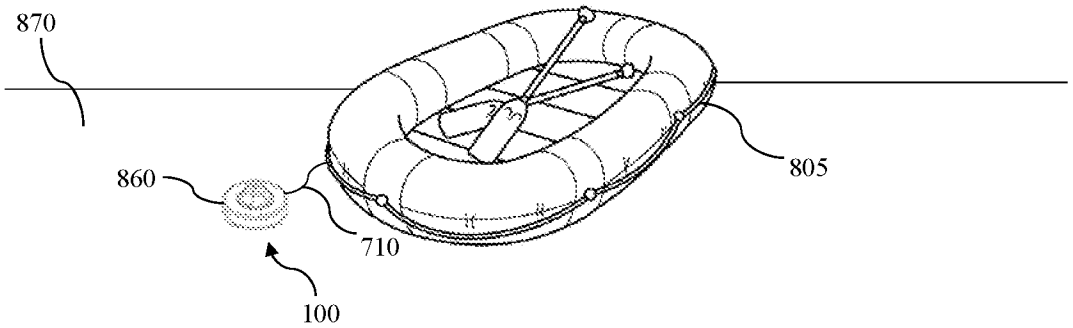
FIG. 8 is a perspective view of a signaling apparatus floating in water and coupled to a life raft by a lanyard.

Referring now to the Figures, FIGS. 1A and 1B illustrate the signaling apparatus 100, having a buoyant ring coupled thereto, according to certain embodiments. The signaling apparatus is configured to couple to an emergency flotation device by a lanyard or cord (as illustrated in FIGS. 7 and 8) and to float when immersed in water. The apparatus includes a hermetically sealed housing 105. It is also understood that the signaling apparatus can also be used when not immersed in water by activating the apparatus using the coupling element 145 (further explained below).

The hermetically sealed housing encases a light emitting device configured to be conductively coupled, via electrical circuitry with a power source for powering the light emitting device. The light emitting device may include light emitting diode (LED), organic light emitting diodes (OLEDs), polymer light emitting diodes (PLEDs), and electro-luminescence (EL) lamps. Additionally, other light sources or light emitting devices may also be used and are within the spirit and scope of the present invention.

The hermetically sealed housing includes a transmissive section 110 for allowing light to pass through said housing. The transmissive section may include transparent material, such as glass, plastic, polymeric transparent materials. Additionally, other transparent materials that allow light to pass from inside the housing to outside the housing may also be used and are within the spirit and scope of the present invention. The present embodiment, the transmissive section is a somewhat dome shaped body having a plurality of facets thereon. The transmissive section is such that it provides 360° light transmission. The transmissive section and such that when immersed in water, it can provide light in all directions.

The cylindrical base 120 is coupled proximate to the lower end 155 of the transmissive section. The cylindrical base may contain components and electrical circuitry and power source for powering the light emitting device. In certain other embodiments (not shown), the base may form other shapes such as rectangular, square, etc. in other shapes are within the spirit and scope of the present invention. The base may comprise polymeric materials such as polycarbonates, such as Lexan™, Makrolon™. Additionally, other materials may be used and are within the spirit and scope of the present invention.

The light emitting device may protrude from the cylindrical base and into the transmissive section inside the housing. Referring to FIG. 1A, FIG. 1A illustrates an opening on the lower end of the base of the housing where the electrical circuitry may be inserted into and then hermetically sealed using epoxy. It is understood that the lower end of the base of the housing will be sealed such that water does not intrude into the device.

A buoyant ring 160 is proximate to the lower section of the transmissive section of the housing such that the transmissive section of the housing faces upward when the apparatus was water. Essentially, the buoyant ring acts as a life ring to the apparatus and facilitates the apparatus to remain afloat when in the water. The buoyant ring comprises opaque or material that prevents light from transmitting downward. In operation, when the device is immersed in water, when light transmits from the light emitting device, the life ring positioned below the lower section of the transmissive section 110 facilitates in preventing light from being transmitted downward into the water. Because light is prevented from being transmitted downward, it prevents the encouragement of sea life from being attracted to the apparatus. The buoyant ring may comprise material such as sponge, phone, foam, Cork, wood, and plastic foams, such as polyvinyl chloride and polyethylene. Additionally, other types of buoyant materials may also be used and are within the spirit and scope of the present invention.

Figure 2B:
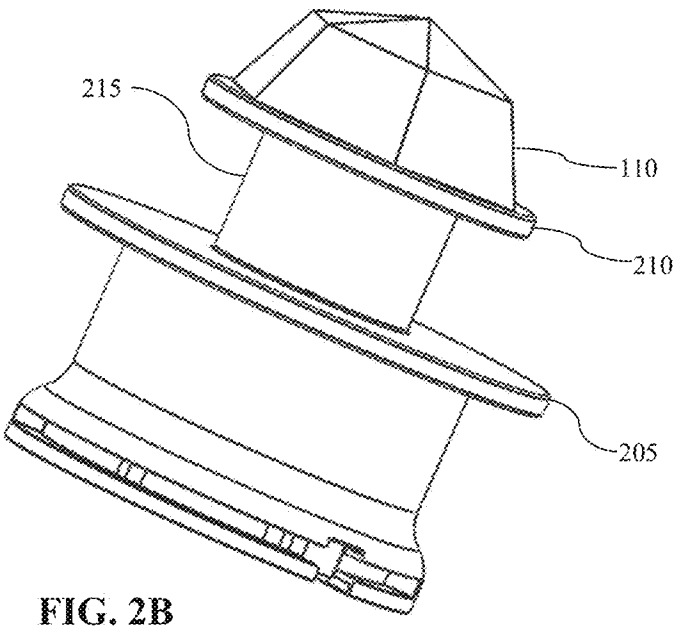
FIG. 2B is a perspective view of a signaling apparatus without a buoyant ring coupled thereto, according to an example embodiment.
Figure 2A:
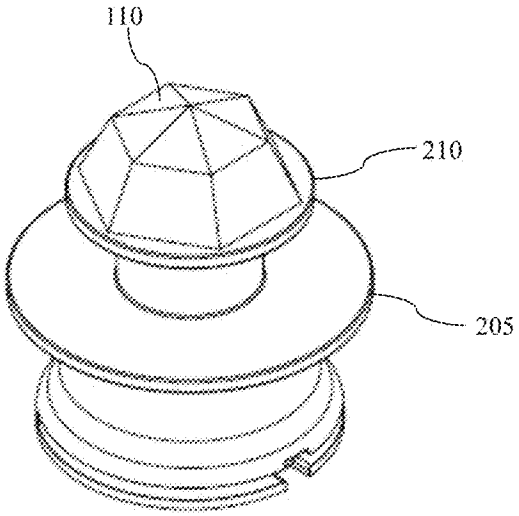
FIG. 2A is a perspective view of a signaling apparatus without a buoyant ring coupled thereto, according to an example embodiment.

FIGS. 2A and 2B are perspective views of the signaling apparatus, wherein the buoyant ring has been removed, according to one example embodiments. FIGS. 2A and 2B illustrates that the housing may comprise an upper flanged section 210 and a lower flanged section 205. The upper and lower flanged sections are aligned parallel to one another on either end of a cylindrical shaped section 215. The cylindrical shaped section and the flanged sections are configured to receive the buoyant ring 160.

Figure 4:
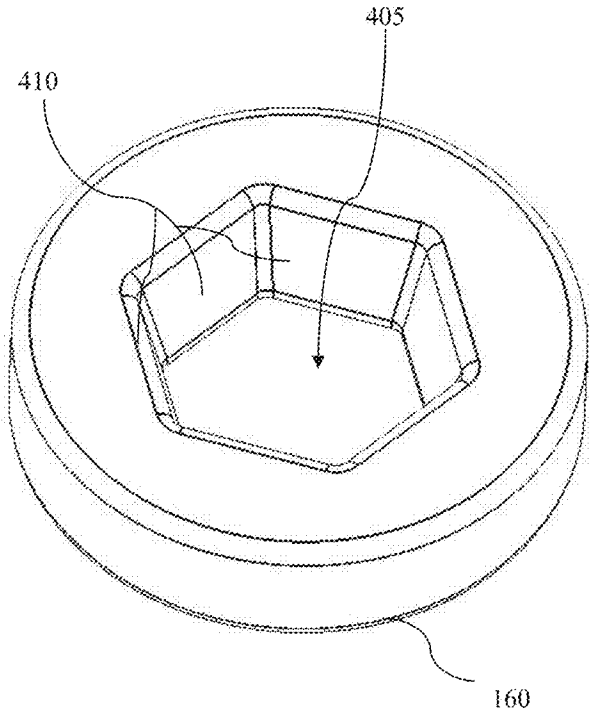
FIG. 4 is a perspective view of a buoyant ring of the signaling apparatus according to an example embodiment.

Moving to FIG. 4, FIG. 4 is a perspective view of a buoyant ring, according to one example embodiment of the present invention. The buoyant ring has an opening 405. The opening is configured to receive the cylindrical shaped section 215 of the apparatus such that the ring may be coupled to the signaling apparatus. As mentioned above, the buoyant ring may comprise material that allows the signaling apparatus to remain afloat allowing the transmissive section 110 to remain above water.

A first conductive surface 125 is positioned on the outward facing surface of the cylindrical base. A second conductive surface 130 is positioned on the outward facing surface of the cylindrical base. The first and second conductive surfaces may be connected to probes 916, 917 is further explained below and illustrated in FIGS. 9A-9C. The electrical circuitry within the housing includes a switching means configured to move a timing circuit of the electrical circuitry from an inactivated state to an activated state when the first and second conductive surfaces are conductively coupled to each other. In the present embodiment, the first and second conductive surfaces are configured to be conductively coupled mechanically by a coupling element 145 and when a body of water spans, for at least momentarily, from the first conductive surface to the second conductive surface (further explained below). In other words, when the apparatus is immersed in water, an electrical path is established between the first and second conductive surfaces, which are coupled to the terminals or probers 916 and 917 of the electrical circuitry (further explained below). In one embodiment, the first and second conductive surfaces can be a flat surface, a curved surface, multiple angled surfaces, etc.

When in the deactivated state, the timing circuit is configured to prevent electrical current from the power source from flowing to the light emitting device. When in the activated state the timing circuit is configured to allow electrical current from the power source to flow to the light emitting device such that light can be emitted from the light emitting device at a predetermined repeating lighting pattern. The timing circuit is configured to remain in the activated state for an amount of time greater than the amount of time the first and second surfaces are conductively coupled to each other due to the configuration of the capacitor 913 and related electrical components (further explained below).

Figure 9A:
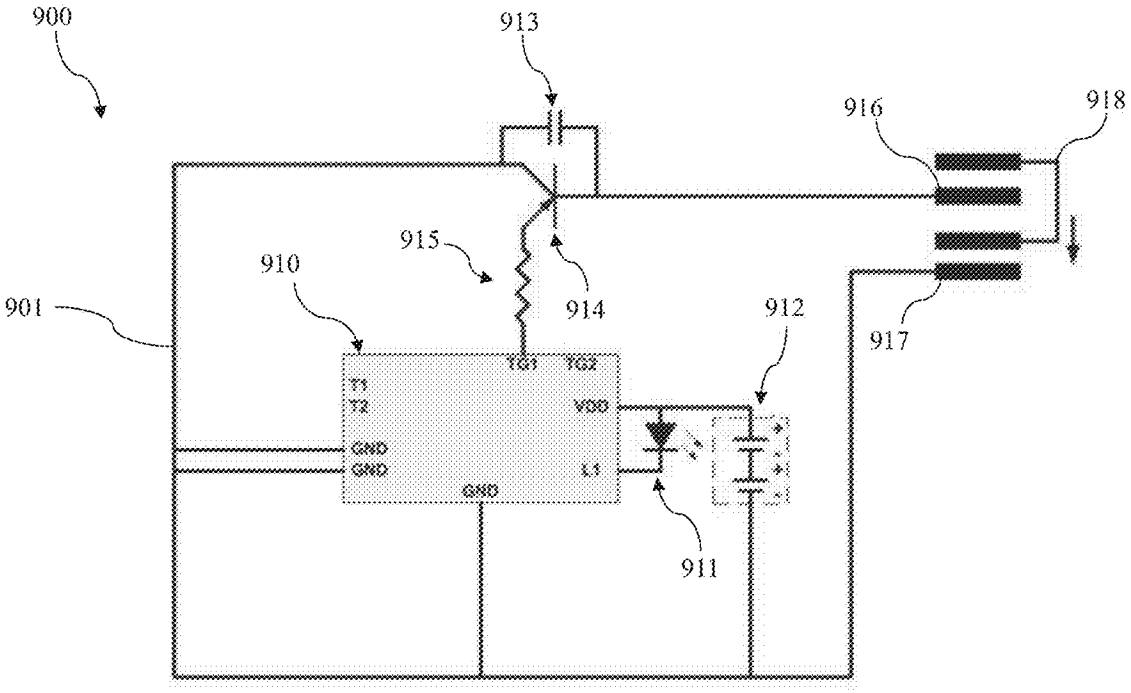
FIG. 9A is a diagram illustrating the electrical circuitry of the signaling apparatus in a non-coupled state.
Figure 9B:
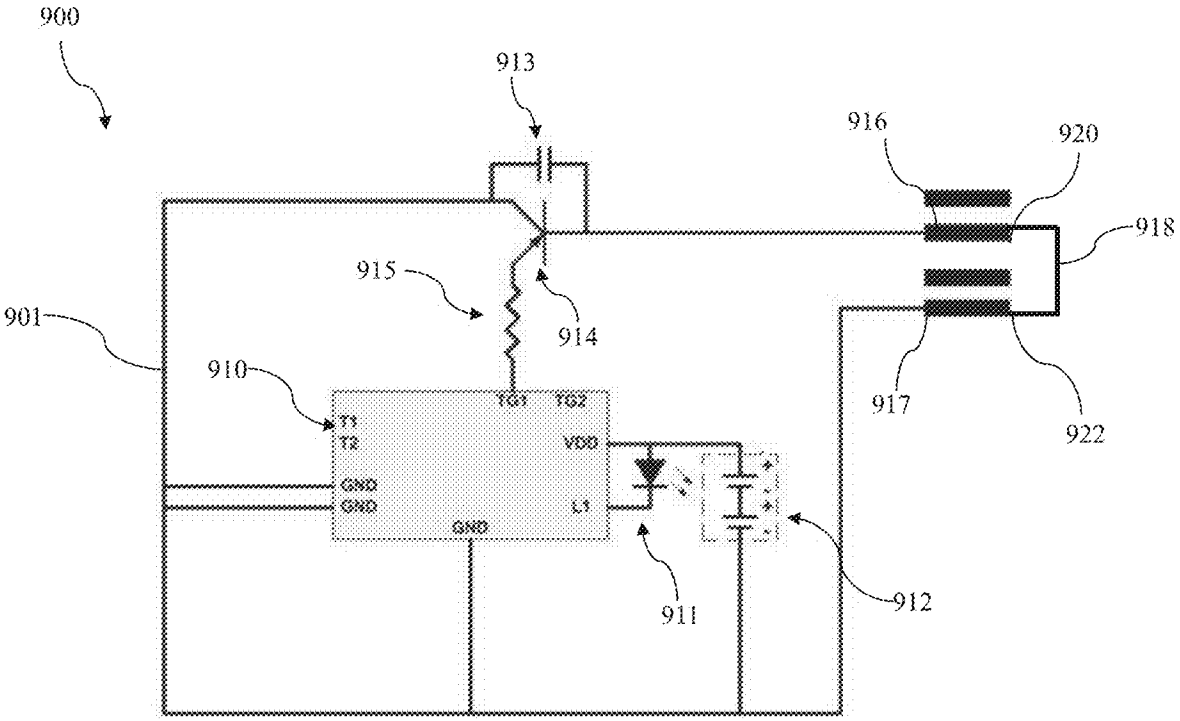
FIG. 9B is a diagram illustrating the electrical circuitry of the signaling apparatus in a coupled state.

The first conductive surface is configured to conductively coupled with the first terminal 916 and the second conductive surface is configured to the second terminal 917 (as illustrated in FIG. 9A and FIG. 9B). The first and second conductive surfaces may each be an end of terminals probes 916, 917, respectively. The first conductive surface and second conductive surface may comprise conductive material such as metal, aluminum, nickel, copper, etc. Additionally, other materials may be used and are not within the scope of the present invention. Additionally, the first and second conductive surfaces may be nickel plated on the outward facing section and the remainder of the probes may also be nickel plated in order to decrease oxidation.

In the present embodiments, at least one groove is included on the outward facing surface of the cylindrical base. The present embodiment as illustrated in FIGS. 1A and 1B, a first grove 135 and an opposing second groove 140 is positioned on the lower or downward facing end of the apparatus. In the present embodiments, the first and second grooves are rectangular shaped and have a floor and opposing sidewalls extending radially outward from the floor surface. In the present embodiments, the first conductive surface is arranged proximate to a first section of the first groove 135 and the second conductive surface is arranged proximate to a first section of the second groove (further explained below). In the present embodiment, the first and second conductive surfaces are rectangular shaped surfaces, however it is understood that other shapes and types of surface may also be used.

Figure 3:
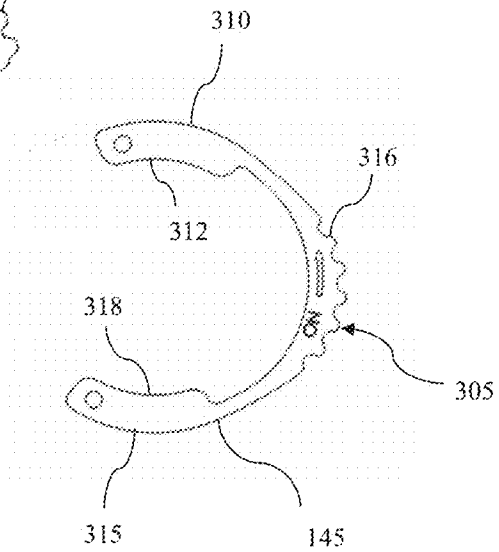
FIG. 3 is a top view of a coupling means of the signaling apparatus according to an example embodiment.

A coupling element 145 is configured to rotatably couple within the at least one groove of the cylindrical base. On embodiment of the coupling element is illustrated in FIG. 3. Referring to FIG. 3, the coupling element includes a lever element 305 positioned between a first curved arm 310 and a second curved arm 315. In one embodiment, the lever element comprises a series of grooves 316 proximate to the center of the coupling element so that a user can more easily apply force to rotate the coupling element when the coupling element is clamped onto the base of the signaling apparatus.

Figure 3A:
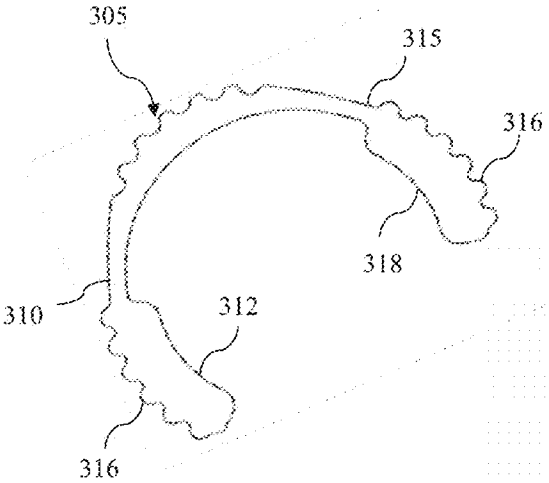
FIG. 3A is a top view of a coupling means of the signaling apparatus according to another example embodiment.

Referring now to FIG. 3A, FIG. 3A is a top view of another embodiment of a coupling element. A serves of grooves 316 may be positioned proximate to each of the ends of the coupling element such that a user can more easily apply force to rotate the coupling element when the coupling element is clamped onto the base of the signaling apparatus. Similar to the embodiment of the coupling element illustrated in FIG. 3, the coupling element of FIG. 3A includes a lever element 305 positioned between a first curved arm 310 and a second curved arm 315. The embodiment also illustrated in FIG. 3A is also illustrated as in FIG. 1B. In this embodiment, the series of grooves 316 is located so that a user can more easily apply force to rotate the coupling element when the coupling element is clamped onto the base of the signaling apparatus. In the embodiment illustrated in FIG. 3A, the series of grooves on each of the ends of the coupling element may also define the lever element.

Additionally, other lever element shapes may also be used and are within the spirit and scope of the present invention. In other embodiments, a triangular shaped lever element may be used in order for a person to apply force to the coupling elements in order to rotate the coupling element within the groove of the signaling apparatus. In essence the lever element defines at least one surface, bar, or body that allows the coupling element to rotate when forces act upon the lever element.

The first curved arm includes a first inward protruding element 312 and the second curved arm includes a second inwardly protruding element 318. The coupling element is configured such that the first and second arms partially clamp the cylindrical base such that the inwardly protruding elements are positioned within the at least one groove. In other embodiments not shown, coupling elements be other devices that allows a user to mechanically conductively couple the first and second conductive surfaces.

As illustrated in FIGS. 1A and 1B, the first arm and inwardly protruding element is positioned within the first groove and the second arm and second inwardly protruding element is positioned within the second groove. Once within the first and second grooves, the coupling element is configured to rotate. The coupling element comprises conductive material such that the first conductive surface is conductively coupled with the second conductive surface when the first inwardly protruding element 312 contacts the first conductive surface 120 and the second inwardly protruding element 318 contacts the second conductive surface 125. As will be explained below, when the coupling elements conductively couples the first conductive surface to the second conductive surface, a circuit of the electrical circuitry is closed, thereby allowing the device to move into the activated state. As mentioned above, when in the activated state the timing circuit is configured to allow electrical current from the power source to flow to the light emitting device such that light can be emitted from the light emitting device at a predetermined repeating lighting pattern.

Figure 6:
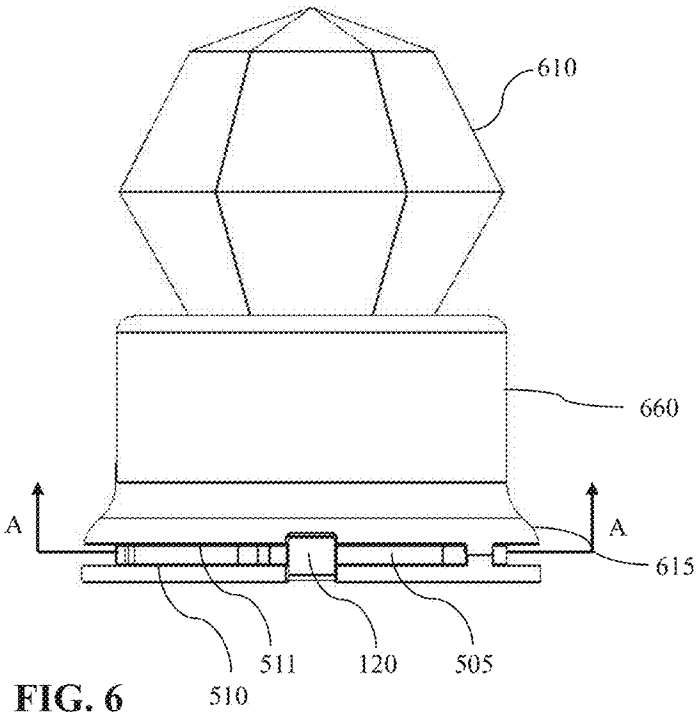
FIG. 6 is a perspective view of a signaling apparatus having a buoyant ring coupled thereto, according to another example embodiment.
Figure 5:
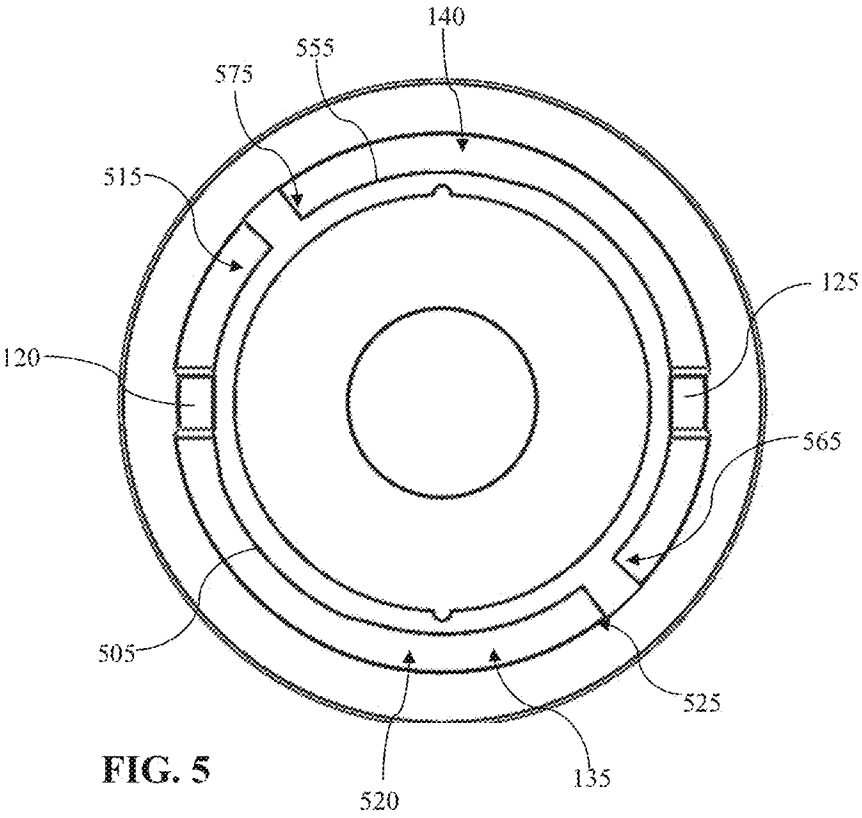
FIG. 5 is a bottom cross-sectional view of a base section of the signaling apparatus taken along line A in FIG. 6 such that a cross-sectional view of a first groove and a second groove is illustrated.

FIG. 5 is a cross-sectional view of a first and second groove of the signaling apparatus, according to one example embodiment, taken along line A of FIG. 6. As mentioned above, the signaling apparatus comprises a first groove 135 and an opposing second groove 140. The first groove comprises a floor 505 and a pair of walls 510, 511 that extend radially outward from each side of the floor. Similarly, the second groove comprises a floor 555 and a pair of walls and extend radially outward from the floor. As mentioned above, the first groove comprises a first conductive surface 120 proximate to the first end 515 of the groove. Similarly, the second groove comprises a second conductive surface 125 proximate to the first end and 565 of the second groove.

In one embodiment, the first groove defines a first inclined floor. The first inclined floor has a slope such that the sidewalls 510, 511 of the first groove have a first height proximate to the first end of the first groove that is less than a second height proximate to the second end 525 of the first groove. The sloped of the first inclined floor provides somewhat of a locking mechanism such that a user would have to apply an increased amount of force to rotate the coupling element that the first inwardly protruding element 312 couples with the first conductive surface 120.

Similarly, the second groove may also define an inclined floor. The inclined floor of the second groove is sloped such that the sidewalls of the second groove have a first height proximate to the first end 565 of the second groove that is less than a second height proximate to the second end 575 of the first groove. Similar to the first groove, the slope of the second inclined floor provides somewhat of a locking mechanism such that a user would have to apply an increased amount of force to rotate the coupling element such that the second inwardly protruding element 318 conductively couples with the second conductive surface 125.

Referring to FIGS. 1A, 1B and 3 and 5, the coupling element 145 is configured such that a force can be applied to the coupling element to rotate the coupling element between a coupled state and a non-coupled state. In the coupled state, the first inwardly protruding element 312 contacts the first conductive surface 120 and the second inwardly protruding element 318 contacts the second conductive surface 125. In the non-coupled state, the first inwardly protruding element does not contact the first conductive surface. In non-coupled state, the inwardly protruding elements 318, 312 are positioned proximate to the second ends 525, 575 of the first and second grooves such that the first and second inwardly protruding elements do not contact the first and second conductive surfaces.

If in the non-coupled state, a force can be applied to the lever element 305 of the coupling element such that the coupling element is rotated so that the inwardly protruding elements rotate within the grooves moving the coupling elements proximate to the first ends of the groove and into the coupled state. If the apparatus is in the coupled state, the force can be applied to the lever element of the coupling element such that the coupling element is rotated so that the inwardly protruding elements rotate within the grooves moving the coupling elements proximate to the second end of the groove and into the non-coupled state.

FIGS. 9A and 9B are diagrams illustrating the main components of the electrical circuitry 900 of the signaling apparatus, according to an example embodiment. FIG. 9A illustrates the electrical circuitry in the non-coupled state. In the non-coupled state, the coupling element 145 (illustrated as 918 in FIG. 9A) is situated in the groove of the base section of the housing so that first and second inwardly protruding elements are not conductively coupled with the first and second conductive surfaces. FIG. 9B illustrates the electrical circuitry in the coupled state according to one embodiment. In the coupled state, the coupling element 145 (illustrated as 918 in FIGS. 9A and 9B) is situated in the groove of the base section of the housing so that first and second inwardly protruding elements are conductively coupled with the first 920 and second 920 conductive surfaces (illustrated as 120 and 125 in FIGS. 1A-2B, 5 and 6). The first and second conductive surfaces may be ends of probes 916, 917. In operation, when force is applied such that the coupling element moves the inwardly protruding elements of the coupling element contacts the first and second conductive surfaces, then the probes 916, 917 are conductively coupled closing circuit.

The electrical circuitry 900 of the apparatus includes a switching means configured to move a timing circuit 910 of the electrical circuitry from an inactivated state to an activated state when the first and second surfaces are conductively coupled to each other. In the deactivated state, the timing circuit is configured such that current is prevented from following from the power source 912 to the light emitting device so that power is not provided to the light emitting device. In the activated state, the timing circuit is configured such that current flows from the power source such to the light emitting device such that power is provided to the light emitting device so that light can be emitted from the light emitting device 912 at a predetermined repeating lighting pattern (further explained in FIG. 9C).

In one embodiment, the electrical circuitry includes a power source 912. In the present embodiment as illustrated in FIGS. 9A and 9B, the power source comprises an assembly of batteries. In one non-limiting embodiment, the battery assembly and 12 consists of two series CR2032 3V lithium batteries with a capacity of 163 mAh. However, it is understood that at least one battery may be used, and usage of additional batteries also may be used and are within the scope of the present invention. In one non-limiting embodiment, as illustrated in FIGS. 9A and 9B, the positive terminal of the battery is conductively coupled to the timing circuit 910 at the input VDD of the timing circuit with the negative terminal of the battery assembly circuit connected to ground. Internally, the timing circuit comprises a switching means that is configured to connect and disconnect the VDD from the internal timing circuitry of the timing circuit 910. The switching means is configured such that the timing circuit in an ultra-low power off state unless input TG1 is pulled low. Internally TG1 is pulled high with a pull-up resistor.

When in the non-coupled state as illustrated in FIG. 9A, and when the device is not emerged in water providing an electrical path between the first and second conductive surfaces via water (the inactivated state), the coupling element 918 does not conductively couple terminal 916 and terminal 917 and as a result, terminals or probes 916 and 917 are in an open state such that there is no conduction between the two terminals. In the inactivated state, capacitor 913 will charge from TG1 through transistor 915 and the emitter-base junction of transistor 914. In one non limiting embodiment, the capacitor can be a 104P 0805 capacitor, however, it is understood that other capacitors may be used and are within the spirit and scope of the present invention. In one non-limiting embodiment, the transistor may include a S8550 PNP transistor. In the inactivated state with the terminals open, the voltage across capacitor 913 will be in a steady state and sufficiently high enough such that the transistor 914 will be cutoff. In this inactivated state, the TG1 pin of the timing circuit 910 will be in the high state, thus keeping the internal power switch circuit or switching means inside the timing circuit in the off state or what can be referred to as the ultra-low power off state or inactivated state. The power switch inside the timing circuit 910 may include a transistor, multiple NPN or PNP transistors, etc. However, it is understood other embodiments of solid-state components may also be used and are within the spirit and scope of the present invention in order to prevent the electrical circuitry of the signaling apparatus from providing power from the power source 912 to the light emitting device 911 in the inactivated state. It is also understood that the electrical circuitry may include sensors at various positions inside of the timing circuit 910 as well as other positions of the electrical circuitry that are configured to sense the position of the switching means within the apparatus and then send to a processer within the device.

When in the deactivated or inactivated state, which is provided when the signaling apparatus is not immersed in water and when in the non-coupled state, the power draw from the power supply 912 is kept low for the timing circuit by keeping most of the circuitry in the timing circuit 910 turned off when the electrical circuitry is not activated by water or the coupling element. The current draw in this state consists mostly of very low leakage currents allowing the overall circuitry to last several years in this state without significantly reducing the operational time.

In one non-limiting embodiment, the coupling element 918 can be positioned so that the first and second conductive surfaces are conductively coupled to each other establishing an electrical path between the or probes terminals 916, 917 hereby providing the electrical circuitry into an activated state. Similarly, when the signaling apparatus is immersed in water, water spans from the first conductive surface to the second conductive surface establishing an electrical path via the water and thereby conductively coupling the first and second conductive surfaces of probes or terminals 916 and 917 configuring the electrical circuitry into an activated state. When terminals 916 and 917 are conductively coupled, current flows between the terminals discharging the capacitor 913 until the voltage at the base of the PNP transistor 914 is low enough to cause a base current of significant magnitude to drive emitter-collector conduction of the transistor toward saturation. This essentially pulls the TG1 input of the timing circuit low enough to turn on internal power switch circuit for internal timing circuit thereby moving the electrical circuitry into the activated state. This enables the electrical circuitry which ultimately provides power from the power source 912 to the light emitting device 911 according to the strobe timing patterns programmed into the internal timing circuit.

Figure 9C:
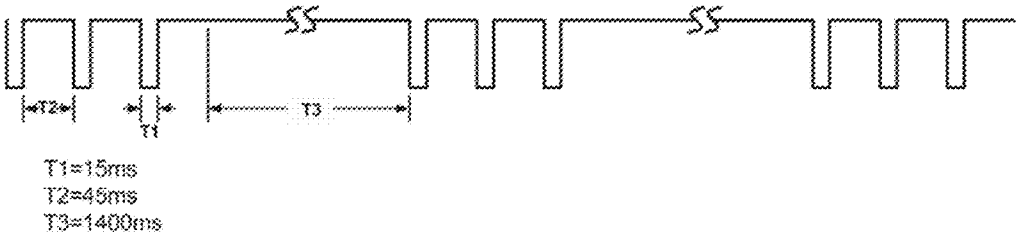
FIG. 9C is a diagram of a repeating lighting pattern, according to one example embodiment; and, FIG. 10 is an illustration of main components of a processor that may be included along with the device.

In one non-limiting embodiment, in the activated state the currents draw consists of two main components. The first component is the current draw of the timing circuit 910 when active. This current draw is typically 0.1 mA. The second component is the current draw through the light emitting device 911. In one embodiment the light emitting object is a 5 mm LED. Although this current of the light emitting device is higher, the average current is only a fraction of on state current due to the 2.85% duty cycle of the waveform as illustrated in FIG. 9C. The average current is therefore approximately or 0.57 mA. Adding the two main current components together yields a total typical activated state current draw of about 0.67 mA. Because of the extremely low current draw when the circuit is in the activated state, the light emitting device will remain operational for hundreds of hours.

When moving from the activated state to the inactivated state, when conductive surfaces 916 and 917 are initially opened after being removed from the water (and when the coupling element no longer is in the coupled state), the capacitor 913 will be in a near drained state and will charge from TG1 (pulled high internally through a pullup resistor) through resistor 914 and emitter-base of transistor 914 causing the emitter-collector to remain in the conducting state for a short period of time as capacitor 913 charges.

However, it is understood that other sized resistors may be used in order to increase or decrease the length of the short period of time that the capacitor charges and the emitter-collector remains in the conducting state. In one embodiment, the resistor is a 200 ohm 0603 resistor, however, it is understood that other sized resistors may also be used. This will keep the internal power switch or switching means of internal timing circuit 910 from turning off immediately during short periods of time when the probes are not exposed to water. As a result, the timing circuit is configured to remain in the activated state for the amount of time greater than the amount of time that the first and second conductive surfaces and first and second conductive surfaces 916, 917 are conductively coupled with each other. The configuration is such that if the signaling apparatus is temporarily removed from the water, such as what may occur given wave action, the timing circuit will remain activated for periods of time when the device is not submerged.

In one non-limiting embodiment, when the internal timing circuit is in the activated state, the cathode side of light emitting source 911 is driven low through though output L1 on timing circuit through an open drain n channel MOSFET transistor internal to timing circuit 910. The anode side of light emitting device 911 is powered directly from the batteries. The timing circuit drives the gate of the open drain n channel MOSFET which in turn produces the waveform at the output L1 of timing circuit shown in FIG. 9C. However, it is understood that other repeating lighting patterns or waveforms may be programmed or used and are within the spirit and scope of the present invention. Whenever the output at L1 is pulled low, current is allowed to flow through the MOSFET to ground, thus allowing power to be provided from the power source to the light emitting device. However, it is also understood that other switching means may also be used for moving between the activated state and inactivated state, which are within the spirit and scope of the present invention.

Figure 10:
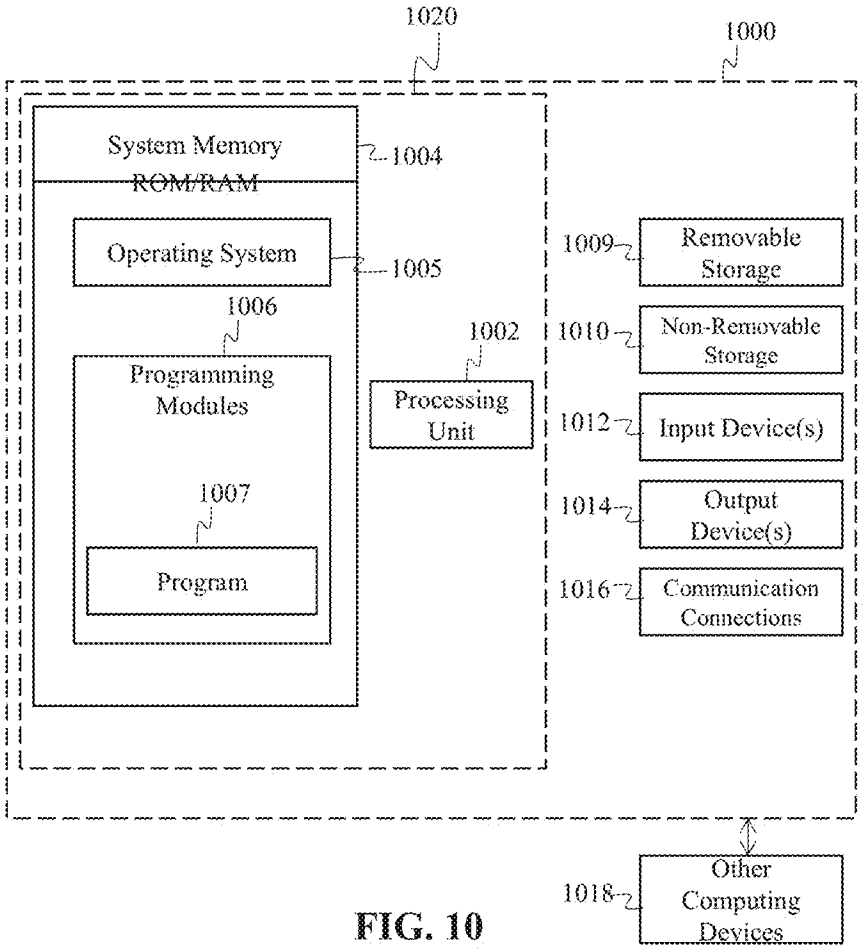

FIG. 9C illustrates one embodiment of a repeating lighting pattern, according to one example embodiment. The timing circuit that may be programmed or configured to provide a variety of repeating lighting patterns. In one embodiment, the predetermined repeating lighting pattern comprises a repeating cycle of a first lighting pulse set followed by a long delay period of time. The first pulse set comprises at least one pulse of light being emitted from the light emitting source. The long delay period of time comprises no light being emitted from the light emitting source. As illustrated in FIG. 10, the first lighting set may include three pulses of light T1, each pulse between 10 ms-20 ms (illustrated as 15 ms in FIG. 9C), wherein each pulse of light is followed by a 40 ms-50 ms short time delay T2 (illustrated as 45 ms in FIG. 9C). However, it is understood that other repeating lighting patterns may also be used and are within the spirit and scope of the present invention. As illustrated in FIG. 10, the long delay period of time T3 is between 1300 ms-1500 ms (illustrated as 1400 ms in FIG. 9C). Similarly, as with the pulses of light, it is understood that other repeating lighting patterns may also be used and are within the spirit and scope of the present invention.

Referring to FIG. 7, FIG. 7 illustrates the signaling apparatus 100 attached in close a lanyard 720 in close 770 proximity to a life vest 705 worn by a human. The signaling apparatus 100 is illustrated floating in water. The buoyant ring 860 maintains the transmissive section 710 of the housing above water and the lower end of the base section would be immersed in the water. As a result, the first 120 and second 125 conductive surfaces (not shown in FIG. 7) would be conductively coupled by the electrical path of the water so that the signaling apparatus can be configured in the activated state to emit light through the transmissive section.

Similar to FIG. 7, FIG. 8 illustrates the signaling apparatus 100 attached in close a lanyard 820 in close proximity to a life raft 805. The significantly apparatus is floating in water 870. The buoyant ring 860 maintains the transmissive section 110 of the housing above the water and the lower end of the base section would be immersed in the water. As a result, the first 120 and second 125 conductive surfaces (not shown in FIG. 8) would be conductively coupled by the electrical path of the water. As a result, the signaling device would be in the activated state and the signaling device would emit light through the transmissive section according to the lighting pattern programmed into the signaling apparatus.

As mentioned above, one of the improvements over the prior art is that the signaling apparatus 100 provides a mechanical switch to continuously conductively couple the contacting surfaces when the apparatus is not immersed in water. This can be useful when a person is not immersed in the water, for example if a person was in a life raft or vessel wearing a life vest, or on land where the ability to use water to conductively couple the first and second surfaces is not present. Many of the current devices do not teach how to continuously keep the light emitting device activated when not immersed in water.

Referring to FIG. 10, an embodiment of the invention may include a plurality of processors or microprocessors, such as processor 1000. In a basic configuration, computing device or processor 1000 may include at least one processing unit 1002 and a system memory 1004. Depending on the configuration and type of computing device, system memory 1004 may comprise, but is not limited to, volatile (e.g. random access memory (RAM)), non-volatile (e.g. read-only memory (ROM)), flash memory, or any combination or memory. System memory 1004 may include operating system 1005, one or more programming modules 1006 (such as program module 1007). Operating system 1005, for example, may be suitable for controlling computing device 1000's operation. In one embodiment, programming modules 1006 may include, for example, a program module 1007. Furthermore, embodiments of the invention may be practiced in conjunction with a graphics library, other operating systems, or any other application program and is not limited to any particular application or system. This basic configuration is illustrated in FIG. 10 by those components within a dashed line 1020.

Computing device 1000 may have additional features or functionality. For example, computing device 1000 may also include additional data storage devices (removable and/or non-removable) such as, for example, magnetic disks, optical disks, or tape. Such additional storage is illustrated in FIG. 10 by a removable storage 1009 and a non-removable storage 1010. Computer storage media may include volatile and nonvolatile, removable and non-removable media implemented in any method or technology for storage of information, such as computer readable instructions, data structures, program modules, or other data. System memory 1004, removable storage 1009, and non-removable storage 1010 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 1000. Any such computer storage media may be part of device 500. Computing device 500 may also have input device(s) 1012 such as a keyboard, a mouse, a pen, a sound input device, a camera, a touch input device, etc. Output device(s) 1014 such as a display, speakers, a printer, etc. may also be included. The aforementioned devices are only examples, and other devices may be added or substituted.

Computing device 1000 may also contain a communication connection 1016 that may allow device 1000 to communicate with other computing devices 1018, such as over a network in a distributed computing environment, for example, an intranet or the Internet. Communication connection 1016 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 1004, including operating system 1005. Computing device 1002 may also include a graphics processing unit 1003, which supplements the processing capabilities of processor 1002 and which may execute programming modules 1006, including all or a portion of those apparatus shown in FIGS. 9A and 9B above. The aforementioned processes are examples, and processing units 1002, 1003 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the invention.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A signaling apparatus for coupling to an emergency flotation device, the signaling apparatus comprising:

(a) a hermetically sealed housing for encasing a light emitting device configured to be conductively coupled, via an electrical circuitry, with a power source for powering said light emitting device, wherein the housing comprises:

a transmissive section for allowing light to pass through said housing;

a cylindrical base section coupled to the transmissive section;

a first conductive surface on an outward facing surface of the cylindrical base;

a second conductive surface on the outward facing surface of the cylindrical base;

at least one groove on the outward facing surface of the cylindrical base, said groove including the first conductive surface arranged proximate to a first section of said groove and the second conductive surface arranged proximate to a second section of said groove;

(b) a coupling element configured to rotatably couple within said groove of the cylindrical base, the coupling element comprising:

a lever element;

a first curved arm having a first inwardly protruding element;

a second curved arm having a second inwardly protruding element;

the coupling element configured such that the first and second arms partially clamp the cylindrical base and the inwardly protruding elements are positioned within said groove; and, wherein the coupling element comprises conductive material such that the first conductive surface is conductively coupled with the second conductive surface when the first inwardly protruding element contacts the first conductive surface and the second inwardly protruding element contacts the second conductive surface;

(c) the first conductive surface and second conductive surface configured to be conductively coupled for an amount of time when a body of water spans, for at least momentarily, from the first conductive surface to the second conductive surface; and, (d) wherein the electrical circuitry includes a switching means configured to move a timing circuit of the electrical circuitry from an inactivated state to an activated state when the first and second surfaces are conductively coupled to each other, wherein in the deactivated state the timing circuit is configured to prevent electrical current from the power source from flowing to the light emitting device, and wherein in the activated state the timing circuit is configured to allow electrical current from the power source to flow to the light emitting device such that light is emitted from the light emitting device at a predetermined repeating lighting pattern, and wherein the timing circuit is configured to remain in the activated state for an amount of time greater than the amount of time the first and second surfaces are conductively coupled to each other.

2. The signaling apparatus of claim 1, wherein the coupling element is configured such that a force can be applied to the coupling element to rotate the coupling element between a coupled state and a non-coupled state, wherein in the coupled state the first inwardly protruding element contacts the first conductive surface and the second inwardly protruding element contacts the second conductive surface, and wherein in the non-coupled state the first inwardly protruding element does not contact the first conductive surface and the second inwardly protruding element does not contact the second conductive surface.

3. The signaling apparatus of claim 1, wherein the predetermined repeating lighting pattern comprises a repeating cycle of a first lighting pulse set followed by a long delay period of time, wherein the first pulse set comprises at least one pulse of light being emitted from the light emitting source, and wherein the long delay period of time comprises no light being emitted from the light emitting source.

4. The signaling apparatus of claim 3, wherein the first lighting set includes three pulses of light, each pulse between 10 ms-20 ms, wherein each pulse of light is followed by a 40 ms-50 ms short time delay.

5. The signaling apparatus of claim 3, wherein the long delay period of time is between 1300 ms-1500 ms.

6. The signaling apparatus of claim 1, wherein a buoyant ring is proximate to a lower section of the transmissive section of the housing such that the transmissive section faces upward when the apparatus floats in water.

7. The signaling apparatus of claim 1, wherein the buoyant ring comprises non-transmissive material such that light is prevented from emitting downward from the transmissive section of the housing.

8. The signaling apparatus of claim 6, wherein the apparatus is coupled in close proximity to the emergency flotation device by a lanyard.

9. The signaling apparatus of claim 1, wherein the first conductive surface and second conductive surface comprise nickel plated.

10. The signaling apparatus of claim 1, wherein the transmissive section defines a dome.

11. A signaling apparatus for coupling within close proximity to an emergency flotation, the signaling apparatus comprising:

(a) a hermetically sealed housing configured for encasing a light emitting device configured to be conductively coupled, via an electrical circuitry, with a power source for powering said light emitting device, wherein the housing comprises:

a dome shaped transmissive section for allowing light to pass through said housing;

a cylindrical base section coupled below the transmissive section;

a buoyant ring proximate to a lower section of said transmissive section of the housing such that the transmissive section faces upward when the apparatus floats in water;

a first conductive surface on an outward facing surface of the cylindrical base;

a second conductive surface on the outward facing surface of the cylindrical base;

a first groove on the outward facing surface of the cylindrical base, the first groove including the first conductive surface arranged proximate to a first section of the first groove;

a second groove on the outward facing surface of the cylindrical base, the second conductive surface arranged proximate to a first section of the first groove;

(b) a coupling element configured to rotatably couple within the grooves of the cylindrical base, the coupling element comprising:

a lever element;

a first curved arm having a first inwardly protruding element;

a second curved arm having a second inwardly protruding element;

the coupling element configured such that the first and second arms clamp the cylindrical base such that the first inwardly protruding element is positioned in the first groove and the second inwardly protruding element is positioned in the second groove; and, wherein the coupling element comprises conductive material such that the first conductive surface is conductively coupled with the second conductive surface when the first inwardly protruding element contacts the first conductive surface and the second inwardly protruding element contacts the second conductive surface;

(c) the first conductive surface and second conductive surface configured to be conductively coupled for an amount of time when a body of water spans, for at least momentarily, from the first conductive surface to the second conductive surface; and, (d) wherein the electrical circuitry includes a switching means configured to move a timing circuit of the electrical circuitry from an inactivated state to an activated state when the first and second surfaces are conductively coupled to each other, wherein in the deactivated state the timing circuit is configured to prevent electrical current from the power source from flowing to the light emitting device, and wherein in the activated state the timing circuit is configured to allow electrical current from the power source to flow to the light emitting device such that light is emitted from the light emitting device at a predetermined repeating lighting pattern, and wherein the timing circuit is configured to remain in the activated state for an amount of time greater than the amount of time the first and second surfaces are conductively coupled to each other.

12. The signaling apparatus of claim 11, wherein the coupling element is configured such that a force can be applied to the coupling element to rotate the coupling element between a coupled state and a non-coupled state, wherein in the coupled state the first inwardly protruding element contacts the first conductive surface and the second inwardly protruding element contacts the second conductive surface, and wherein in the non-coupled state the first inwardly protruding element does not contact the first conductive surface and the second inwardly protruding element does not contact the second conductive surface.

13. The signaling apparatus of claim 11, wherein the predetermined repeating lighting pattern comprises a repeating cycle of a first lighting pulse set followed by a long delay period of time, wherein the first pulse set comprises at least one pulse of light being emitted from the light emitting source, and wherein the long delay period of time comprises no light being emitted from the light emitting source.

14. The signaling apparatus of claim 13, wherein the first lighting set includes three pulses of light, each pulse between 10 ms-20 ms, wherein each pulse of light is followed by a 40 ms-50 ms short time delay.

15. The signaling apparatus of claim 13, wherein the long delay period of time is between 1300 ms-1500 ms.

16. The signaling apparatus of claim 11, wherein the first groove defines a first inclined floor, the first inclined floor configured such that side walls of the first groove have a first height proximate to the first end of the first groove greater than a second height proximate to the second end of the first groove, and wherein the second groove defines a second inclined floor, the second inclined floor configured such that side walls of the second groove have a first height proximate to the first end of the second groove greater than a second height proximate to the second end of the second groove.

17. The signaling apparatus of claim 6, wherein the apparatus is coupled in close proximity to the by a lanyard to the emergency flotation device by a lanyard.

18. A signaling apparatus configured to float in water, the signaling apparatus comprising:

(a) a hermetically sealed housing encasing a light emitting device configured to be conductively coupled, via an electrical circuitry, with a power source for powering said light emitting device, wherein the housing comprises:

a transmissive section for allowing light to pass through said housing;

a base section coupled to the transmissive section;

a first conductive surface on an outward facing surface of the cylindrical base;

a second conductive surface on the outward facing surface of the cylindrical base;

(b) a coupling element comprising a first arm and an opposing second arm, wherein the coupling element comprises conductive material such that the first conductive surface is conductively coupled with the second conductive surface when the first arm contacts the first conductive surface and the second arm contacts the second conductive surface;

(c) the first conductive surface and second conductive surface configured to be conductively coupled for an amount of time when a body of water spans, for at least momentarily, from the first conductive surface to the second conductive surface; and, (d) wherein the electrical circuitry includes a switching means configured to move the electrical circuitry from an inactivated state to an activated state when the first and second surfaces are conductively coupled to each other, wherein in the deactivated state the electrical circuitry is configured to prevent electrical current from the power source from flowing to the light emitting device, and wherein in the activated state the timing circuit is configured to allow electrical current from the power source to flow to the light emitting device such that light is emitted from the light emitting device, and wherein the timing circuit is configured to remain in the activated state for an amount of time greater than the amount of time the first and second surfaces are conductively coupled to each other.

19. The signaling apparatus of claim 18, wherein the coupling element is such that in a coupled state the first arm contacts the first conductive surface and the second arm contacts the second conductive surface, and wherein in the non-coupled state the first arm does not contact the first conductive surface and the second arm does not contact the second conductive surface.

20. The signaling apparatus of claim 6, wherein the apparatus is configured to float in water and to be coupled in close proximity to an emergency flotation device by a lanyard.

* * * * *